United States Patent [19]

Andis

[11] 4,368,376

[45] Jan. 11, 1983

[54] CURLING IRON WITH REMOVABLE GROOMING BARS

[75] Inventor: Matthew L. Andis, Racine, Wis.

[73] Assignee: Andis Company, Racine, Wis.

[21] Appl. No.: 222,590

[22] Filed: Jan. 5, 1981

Related U.S. Application Data

[63] Continuation-in-part of Ser. No. 59,676, Jul. 23, 1979, and Ser. No. 120,511, Feb. 11, 1980.

[51] Int. Cl.[3] ..... A46B 15/00; A45D 24/10; A45D 1/18; H05B 3/02

[52] U.S. Cl. ..... 219/222; 132/9; 132/11 R; 132/85; 132/118; 132/122; 132/142; 132/150; 132/161; 132/163; 219/230

[58] Field of Search ..... 219/222-226, 219/230; 132/7, 9, 11 R, 11 A, 150, 117, 118, 142, 161, 33 R, 40, 85, 122, 163

[56] References Cited

U.S. PATENT DOCUMENTS

| | | | |
|---|---|---|---|
| 1,400,468 | 12/1921 | Warmer | 132/117 |
| 1,861,040 | 5/1932 | Williams | 132/118 |
| 3,660,634 | 5/1972 | Scott | 219/222 |
| 3,750,680 | 8/1973 | Miller | 132/11 R |
| 3,760,821 | 9/1973 | Weddington | 132/118 |
| 4,126,143 | 11/1978 | Schroeder | 132/11 A |
| 4,217,915 | 8/1980 | Gress et al. | 132/9 |
| 4,292,986 | 10/1981 | Ergaver et al. | 132/11 R |

FOREIGN PATENT DOCUMENTS

| | | | |
|---|---|---|---|
| 954436 | 6/1949 | France | 132/150 |
| 1548540 | 7/1979 | United Kingdom | 219/222 |
| 1558737 | 1/1980 | United Kingdom | 219/222 |

*Primary Examiner*—A. Bartis

*Attorney, Agent, or Firm*—Michael, Best & Friedrich

[57] ABSTRACT

An electric hair curling or styling iron includes an elongated cylindrical housing extending from a handle and enclosing an electric heating element. The outer peripheral cylindrical surface of the housing is provided with an even number of radially spaced longitudinally extending grooves. An elongated support bar is removably located in each of the grooves and each bar includes a plurality of longitudinally spaced teeth extending radially outwardly from the longitudinal axis of the housing. The bars are arranged in alternating first and second series. The bars and teeth of the first series are fabricated from a material relatively of high heat transmissibility, such as aluminum. The bars and teeth of the second series are made of a material of relatively low heat transmissibility, such as plastic. The teeth of the second series are longer than the teeth of the first series. The construction permits the relatively short hot teeth of the first series to contact and transmit heat to the hair while the relatively long teeth of the second series, which are relatively cool, groom the hair and prevent contact of hot teeth of the first series with the scalp during use.

1 Claim, 3 Drawing Figures

CURLING IRON WITH REMOVABLE GROOMING BARS

RELATED APPLICATION

This application is a continuation in part of my earlier application Ser. No. 059,676 filed July 23, 1979 and of my earlier application Ser. No. 120,511 filed Feb. 11, 1980.

BACKGROUND OF THE INVENTION

The invention relates generally to hair grooming devices and more particularly to curling irons.

SUMMARY OF THE INVENTION

The invention provides a curling iron comprising a handle, a housing extending from the handle, including an interiorly located heating element, and having a longitudinal axis, and an outer peripheral surface radially spaced from the longitudial axis, which outer surface includes therealong a plurality of angularly spaced rows of longitudinally spaced and radially outwardly extending teeth, which rows of teeth are arranged in alternating first and second series, with the teeth of one of the first and second series being fabricated of material of relatively high heat transmissibility, and with the teeth of the other of the first and second series being fabricated of material of relatively low heat transmissibilty.

The invention also provides a curling iron comprising a handle, a housing extending from the handle, including an interiorly located heating element, and having a longitudinal axis, and an outer peripheral surface radially spaced from the longitudinal axis, which outer surface includes therealong a plurality of angularly spaced rows of longitudinally spaced and radially outwardly extending teeth, which rows are arranged in alternating first and second series, with the teeth of one of the first and second series having a relatively long radial extent, and with the teeth of the other of the first and second series having a relatively short radial extent.

The invention also provides a curling iron comprising a handle, a housing extending from the handle, including an interiorly located heating element, and having a longitudinal axis, and an outer peripheral surface radially spaced from the longitudinal axis, which outer surface includes therealong a plurality of angularly spaced rows of longitudinally spaced and radially outwardly extending teeth, which rows are arranged in alternating first and second series, with the teeth of the first series being fabricated of a material of relatively high heat transmissibility and being of relatively of short radial extent, and with the teeth of the second series being fabricated of material of relatively low heat transmissibility and being of relatively long radial extent.

The invention further provides a curling iron comprising a handle, a housing extending from the handle, including an interiorly located heating element, and having a longitudinal axis and an outer peripheral surface radially spaced from the longitudinal axis, which outer surface include means defining an even number of longitudinally extending grooves, and a respective suppport bar located in each of the grooves and including therealong a plurality of longitudinally spaced and radially outwardly extending teeth.

In one embodiment of the invention, the bars are individually removably located in the grooves.

In one embodiment of the invention, the bars are arranged in alternating first and second series, with the bars of one of the first and second series being fabricated of material of relatively high heat transmissibility, and with the bars of the other of the first and second series being fabricated of material of relatively low heat transmissibility.

In one embodiment in accordance with the invention, the bars are arranged in alternating first and second series, with the teeth of the bars of one of the first and second series having a relatively long radial extent, and with the teeth of the bars of the other of the first and second series having a relatively short radial extent.

In one embodiment in accordance with the invention, the bars are arranged in alternating first and second series, and the bars of the first series are fabricated of a material of relatively high heat transmissibility and the teeth thereof of relatively short radial extent, and the bars of the second series are fabricated of material of relatively low heat transmissibility and the teeth thereof are of relatively long radial extent.

In one embodiment in accordance with the invention, the curling iron further includes an end member removably attached to the housing and including means for preventing removal of the bars from the grooves.

Other features and advantages of the embodiments of the invention will become known by reference to the following general description, claims and appended drawings.

IN THE DRAWINGS

Figure 1:
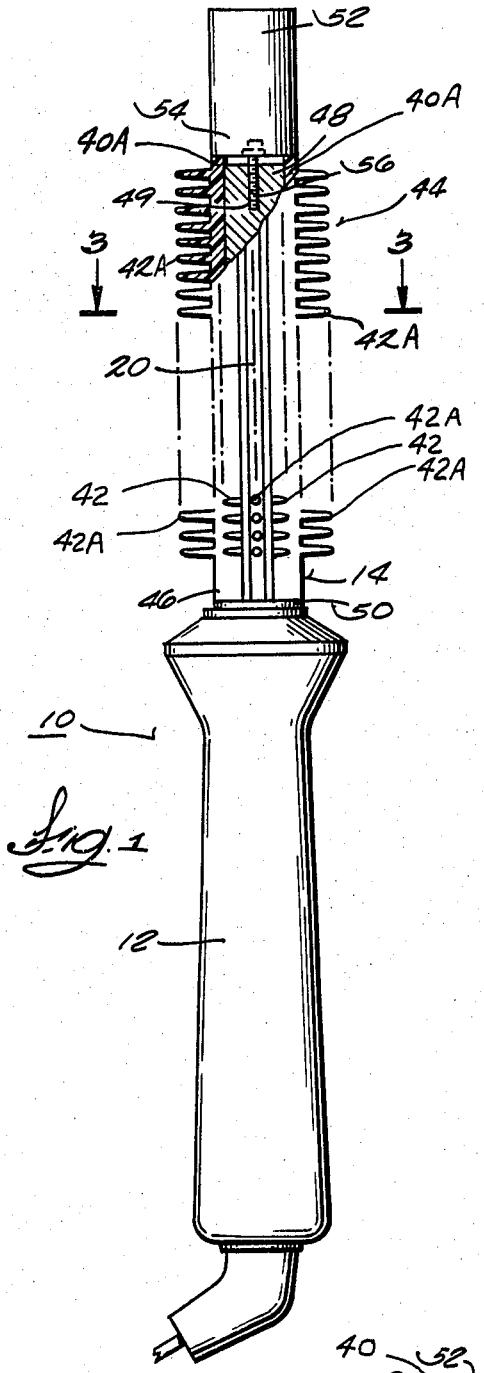
FIG. 1 is an elevational view, partially in section, of a curling iron embodying various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is a curling iron 10. Generally, the curling iron 10 includes a handle 12 and a heat conducting member or housing 14 which extends from the handle 12. The heat conducting member or housing 14 contains therein (see FIG. 3) a heating element 16 which is adapted to be connected to a source of electrical energy (not shown) and which radiates heat which is transferred by the heat conducting member 14 to curl or otherwise style the operator's hair.

In the illustrated embodiment, the heat conducting member 14 is generally of cylindrical form and has an outer peripheral surface 28 and a longitudinal axis 20. While the housing 14 may be constructed of various materials, it is preferably made of a lightweight, heat conducting metal, such as aluminum.

Figure 3:
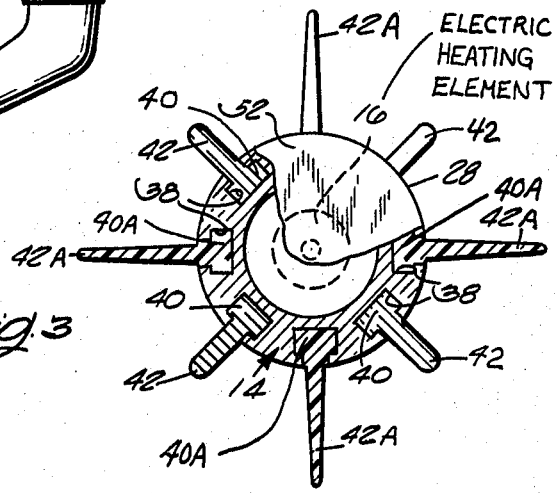
FIG. 3 is an enlarged cross sectional view, partially in section, taken generally along line 3—3 of FIG. 1.

The outer peripheral surface 28 of the housing 14 includes therein a series of arcuately spaced and longitudinally extending grooves 38 which in the illustrated embodiment, are generally dovetail in shape (see FIG. 3). However, it should be appreciated that the specific shape of the grooves 38 may be varied from that shown in the drawings. For example, the grooves 38 may take the shape of any square, rectangular, or arcuate indentation formed on the outer peripheral surface 28 of the housing 14.

Figure 2:
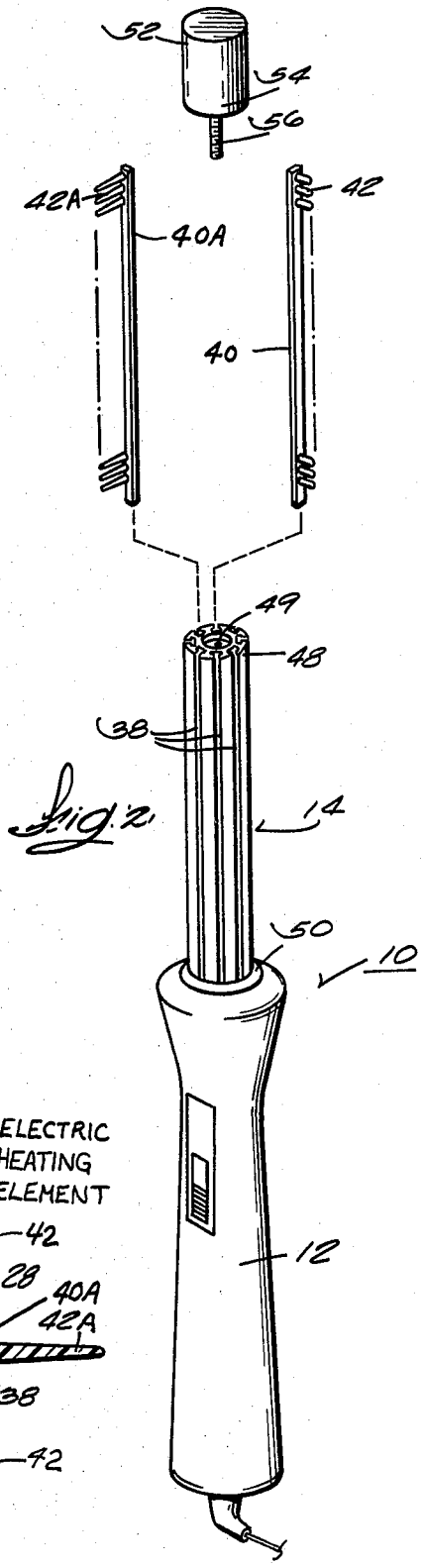
FIG. 2 is an exploded perspective view of the curling iron shown in FIG. 1.

As shown in FIGS. 2 and 3, a support bar 40 or 40A is engageable in each of the grooves 38. A plurality of outwardly extending teeth or bristles 42 or 42A are longitudinally spaced along each of the support bars 40 and 40A. When each groove 38 is occupied by a support bar 40, or 40A as is shown in FIGS. 1 and 3, the teeth or bristles 42 or 42A collectively form a hair grooming attachment 44 on the housing 14 for curling or otherwise styling the operator's hair.

While the support bars 40 and 40A may be glued or otherwise fixedly engaged in the grooves 38, in the illustrated embodiment, the support bars 40 and 40A are fabricated so as to be individually slidable into and out of the dovetail grooves 38. The curling iron 10 is thus adaptable to be variously used with various arrangements of bars, depending upon the requirements of the particular hair curling operation desired.

In some instances, it is desirable alternately to employ bars having relatively long bristles or teeth and bars having relatively short bristles or teeth. In addition, it is also desirable, in some instances, alternately to employ bars fabricated of material of relatively high heat transmissibility, such as aluminum, and bars of relatively low heat transmissibility, such as plastic.

In a preferred construction shown especially in FIG. 3, the bars are arranged in alternating first and second series with the bars 40 in the first series being fabricated of aluminum or other material of high heat transmissibility and having relatively short bristles or teeth 42, and with the bars 40A of the second series being located between the bars 40 of the first series, being fabricated of plastic or other material of relatively low heat transmissibility and having relatively long bristles or teeth 42A. This construction permits transmissibility of heat to the hair by the relatively short teeth 42 and desirably permits the relatively long teeth 42A, which are relatively cool, to be used to groom the hair in the desired manner.

In the illustrated embodiment, the housing 14 includes an inner end 46 adjacent to the handle 12 and an outer end 48 spaced outwardly of the handle 12. An inner end cap 50 (see FIGS. 1 and 2) is glued or otherwise affixed on the inner end 46 of the handle 12. The inner end cap 50 surrounds the inner end 46 of the housing 14 and thereby closes off the grooves 38 at the inner end 46 to prevent movement of the support bars 40 beyond that point.

Additionally, and as is best shown in FIGS. 1 and 2, the housing 14 has an internally threaded hole 49 centrally formed in its outer end 48. A plug-shaped outer tip or end member 52 having an outer diameter generally equal to the outer diameter of the housing 14 is provided. The tip member 52 includes an underbody portion 54 and an externally threaded pin 56 which projects downwardly from the center of the underbody portion 54. Rotation of the tip member 52 causes the pin 56 to threadably engage the hole 49 and to move the underbody portion 54 of the tip member 52 against the outer end 48 of the housing 14. When so attached, the tip member 52 prevents movement of the support bars 40 beyond the outer end 48 of the housing 18. Together, the end cap 50 and the removably plug-shaped tip member 52 retain the support bars 40 in the grooves 38. Likewise, by threadably disengaging the tip member 52 from the hole 49, individual removal of the support bars 40 and 40A from the associated groove 38 is permitted.

The tip member 52 is preferably made of a heat resistant material, such as plastic or rubber. The operator is thus able to freely grasp the tip member 52 to facilitate handling of the curling iron 10 during hair curling operation.

The heat conducting member 14 and associated hair grooming attachment 44 as heretofore described may be used in conjunction with various types of curling irons. For example, the heat conducting member 14 may be used on a curling iron in which the heat conducting member is fixedly attached in an outwardly extending position from the handle. Alternately , the heat conducting member 14 may be used in conjunction with a curling iron of telescopic or "collapsible" construction.

Various of the features of the invention are set forth in the following claims:

I claim:

1. A curling iron comprising a handle, a housing extending from said handle and including an interiorly located heating element, said housing having a longitudinal axis and an outer peripheral cylindrical surface radially spaced from said longitudinal axis, said outer surface including means defining an even number of longitudinally extending grooves, and support bars located in said grooves and each including therealong a plurality of longitudinally spaced teeth extending radially outwardly from said longitudinal axis with the outer ends of said teeth in said rows being spaced from the outer ends of said teeth in adjacent rows at a distance greater than the spacing between said rows adjacent said outer peripheral surface of said housing, said bars being arranged in alternating first and second series, said bars and said teeth thereon of said first series being fabricated of a material having a first heat transmissibility and said teeth thereof having a first radial extent, and said teeth on said bars of said second series being fabricated of material having a second heat transmissibility lower than said first heat transmissibility and having a second radial extent greater than said first radial extent, and an end member removably attached to said housing and including means extending across said grooves for preventing removal of said bars from said grooves.

* * * * *